US005944616A

United States Patent [19]

Horwood et al.

[11] Patent Number: 5,944,616

[45] Date of Patent: Aug. 31, 1999

[54] GOLF CLUBS

[75] Inventors: Graeme Horwood, Stourbridge; John Hutchcocks, Great Barr, both of United Kingdom

[73] Assignee: Apollo Sports Holdings Ltd., Swindon, United Kingdom

[21] Appl. No.: 09/006,855

[22] Filed: Jan. 14, 1998

[30] Foreign Application Priority Data

Jan. 18, 1997 [GB] United Kingdom ..... 97011290

[51] Int. Cl.[6] ..... A63B 53/12

[52] U.S. Cl. ..... 473/289; 473/316

[58] Field of Search ..... 473/287–291, 473/316

[56] References Cited

U.S. PATENT DOCUMENTS

| | | | |
|---|---|---|---|
| Re. 33,735 | 11/1991 | Rumble | 473/323 |
| 3,963,236 | 6/1976 | Mann . | |
| 4,070,022 | 1/1978 | Braly | 473/289 |
| 4,122,593 | 10/1978 | Braly | 473/289 |
| 4,455,022 | 6/1984 | Wright | 473/319 |
| 5,163,681 | 11/1992 | Hodgetts | 473/289 |
| 5,722,899 | 3/1998 | Cheng | 473/289 |
| 5,776,008 | 7/1998 | Lundberg | 473/320 |
| 5,821,417 | 10/1998 | Naruo . | |

FOREIGN PATENT DOCUMENTS

| | | |
|---|---|---|
| 1262896 | 2/1972 | United Kingdom . |
| 1557524 | 12/1979 | United Kingdom . |
| 1598548 | 9/1981 | United Kingdom . |
| 2308549 | 2/1997 | United Kingdom . |

*Primary Examiner*—Jeanette Chapman
*Assistant Examiner*—Stephen L. Blau
*Attorney, Agent, or Firm*—Trexler, Bushnell, Giangiorgi & Blackstone, Ltd.

[57] ABSTRACT

A tubular metal blank for the production of golf club shafts for iron clubs, the blank being at least 44" in length, having a cylindrical tip portion, a cylindrical butt portion, and an intermediate, integral, tapering portion, remaining parameters of the blank including the material, the taper angle, the length of the intermediate portion, and the wall thickness being so chosen as to produce a blank of a stiffness characteristic such that by appropriate trimming of the butt and tip portions of the blank, the blank can be used to produce a shaft for any golf club from a 1 iron to a sand wedge in any of the recognized flex ranges Tour Stiff, S, R and A. There is also disclosed a method of producing a golf club shaft and a means of determining how much to cut from the blank to produce a shaft.

3 Claims, 2 Drawing Sheets

GOLF CLUBS

BACKGROUND OF THE INVENTION

This invention relates to a universal blank for the production of a wide range of golf club shafts, and to a method of producing shafts from such a blank.

U.S. Pat. No. 4,122,593 discloses that a range of different golf club shafts, matched in frequency with one another, can be produced from a common blank. The method of production disclosed in U.S. Pat. No. 4,122,593 is relatively complex, and moreover the range of shafts which can be produced from the blank disclosed in U.S. Pat. No. 4,122,593 is small.

OBJECTS AND SUMMARY OF THE INVENTION

It is an object of the present invention to provide a blank, and a method of manufacturing golf club shafts from the blank, wherein the disadvantages of the blank and method disclosed in U.S. Pat. No. 4,122,593 are obviated.

In accordance with the present invention there is provided a tubular metal blank for the production of golf club shafts for iron clubs, the blank being at least 44" in length, having a cylindrical tip portion, a cylindrical butt portion, and an intermediate, integral, tapering portion, remaining parameters of the blank including the material, the taper angle, the length of the intermediate portion, and the wall thickness being so chosen as to produce a blank of a stiffness characteristic such that by appropriate trimming of the butt and tip portions of the blank, the blank can be used to produce a shaft for any golf club from a 1 iron to a sand wedge in any of the recognized flex ranges Tour Stiff, S, R and A.

The invention further resides in a blank as specified above in combination with means to calculate the amount to be trimmed from the tip and butt portions of the blank to produce a shaft for any iron club in the range 1 iron to sand wedge, and in any of the recognized flex ranges Tour Stiff to A.

Preferably said means to calculate the amount to be trimmed from the tip and butt portions of the blank includes a chart from which the appropriate amounts can be read.

Alternatively the means to calculate includes a computer program for application to a standard personal computer whereby desired characteristics of the golf club can be input, and the program will calculate and output the amount to be trimmed from the butt and tip portions of the blank.

In accordance with a further aspect of the present invention there is provided a method of producing a golf club shaft from a blank of the kind specified above, comprising producing the blank to have a stiffness within a recognized tolerance range, weighing the blank, and utilizing the weight of the blank in combination with other desired characteristics of the golf club to be produced, to determine how much must be cut from the tip, and the butt portions of the blank to produce a shaft which, in combination with a predetermined head and grip will produce a predetermined golf club of a selected stiffness.

BRIEF DESCRIPTION OF THE ILLUSTRATED EMBODIMENT

One example of the present invention will now be described with reference to the accompanying drawings, in which:

FIG. 1 is a side elevational view of a universal blank in accordance with one example of the present invention, FIG. 2 is a diagram indicating the wall thickness at various points along the length of the blank in FIG. 1, and FIG. 3 is a graph illustrating how the blank illustrated in FIGS. 1 and 2 should be trimmed at its tip and its butt portions to produce shafts which, in combination with predetermined golf club heads and grips, would create a wide range of different golf clubs.

DETAILED DESCRIPTION OF THE ILLUSTRATED EMBODIMENT

Figure 1:
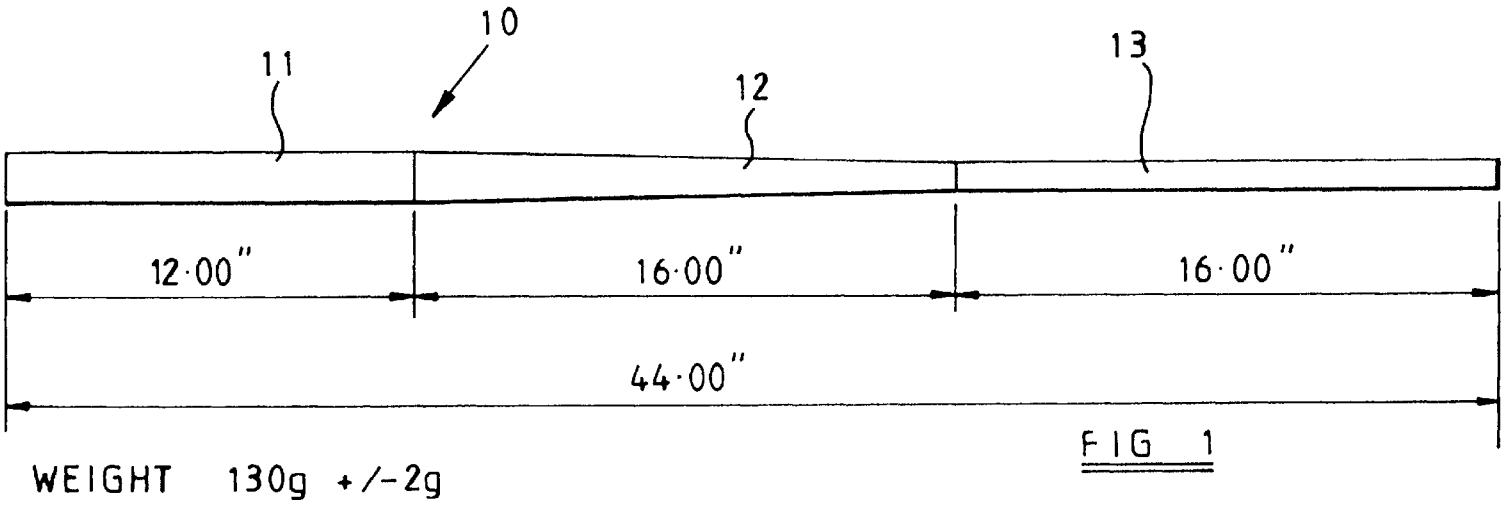
Figure 2:
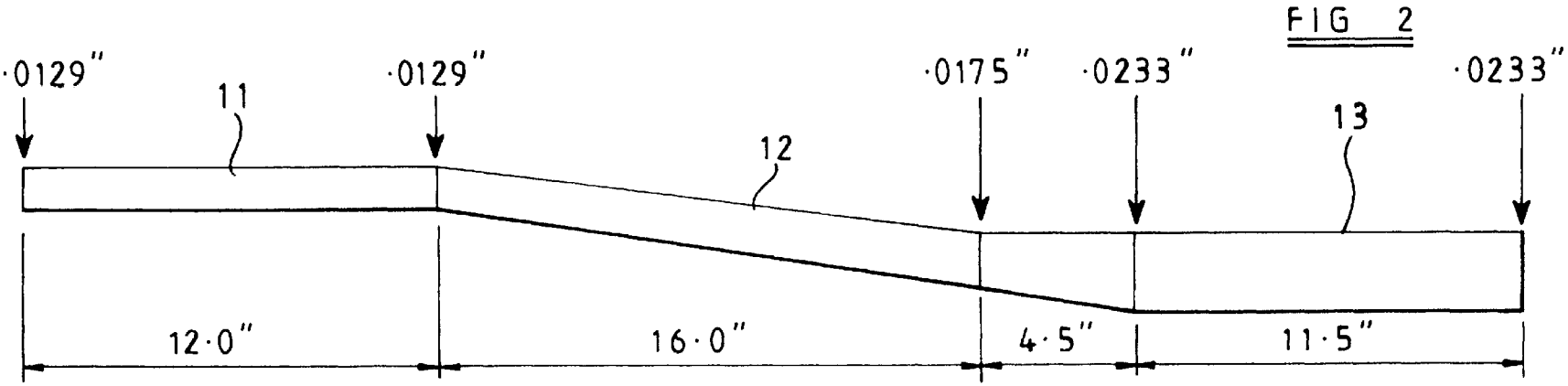

FIG. 1 illustrates one design of blank 10 which can be trimmed to produce a wide range of golf club shafts. The example shown in FIG. 1 is produced assuming that the weight of the grip to be applied to the butt end of a shaft in use is 52 g, the depth by which the tip end of the shaft shall be inserted into the hosel of the golf club head is 1.25", and that the dimension from the heel of the golf club head to the top of the hosel is 2.5". These parameters have been chosen as they are representative of commonly available golf clubs. Similarly, the blank illustrated in FIG. 1 is produced on the assumption that the club swing weight will be D3 and that the clamp length, measured from the butt end of the shaft of the finished club (as used in the standard frequency test applied to golf clubs) is 4".

Bearing the above requirements in mind, and bearing in mind that it is desired to be able to produce, from common blanks, shafts for all of the irons in a set, consisting of 1 iron, 2 iron, 3 iron, 4 iron, 5 iron, 6 iron, 7 iron, 8 iron, 9 iron, pitching wedge, and sand wedge such that after application of grips and heads of known form the clubs will exhibit a known and desired frequency relationship (for example plus five cycles per minute for each club from the 1 iron to the sand wedge) and in any of the recognized stiffness ranges Tour Stiff, S, R and A, the blank has the following further characteristics. The tubular metal blank has an overall length of 44", weighs 130 g (+ or −2 g.), and comprises three integral portions, a butt portion 11 at one end, an intermediate portion 12, and a tip portion 13 at the opposite end. The butt portion is right circular cylindrical, and has an overall length of 12". The external diameter of the butt portion throughout its length is 0.6" and the butt portion has a wall thickness of 0.0129" throughout its length. The intermediate portion is 16" in length, of circular cross-section, and its external diameter tapers uniformly from 0.6" at its merge point with the butt portion to 0.37" at its merge with the tip portion. The wall thickness of the intermediate portion increases uniformly from 0.0129" where it merges with the butt portion to 0.0175" where it merges with the tip portion.

The tip portion is 16" in length and again is right circular cylindrical having an external diameter of 0.37" throughout its length. For the first 4.5" from the merge between the tip portion and the intermediate portion, the wall thickness of the tip portion increases uniformly from 0.0175" at its merge with the intermediate portion, to 0.0233", and the wall thickness thereafter remains at 0.0233" throughout the remaining 11.5" of the length of the tip portion. The blank is produced by a known drawing process from steel tubing, the steel preferred for the example illustrated in the drawings being identified as 42MnCr5 which has the following chemical composition:

| MATERIAL | CONTENT (%) |
|---|---|
| Carbon | 0.4–0.45 |
| Silicone | 0.10–0.35 |
| Manganese | 1.15–1.45 |
| Phosphorous | 0.025 max |
| Sulphur | 0.025 max |
| Chromium | 0.15–0.35 |
| Molybdenum | 0.10 max |
| Nickel | 0.20 max |
| Aluminium | 0.02–0.045 |
| Iron | remainder |

The above steel has a minimum tensile strength of 105 tonf per square inch.

The steel identified above was chosen as it is a known steel for the production of golf club shafts. Using such steel dictates some of the design parameters of the blank which are also set out above. It is to be understood however that selection of a different steel would give rise to different structural parameters of the blank to produce a blank having the same capability of being trimmed to produce shafts for any iron golf club in the range 1 to sand wedge, and any flex in the recognized ranges of Tour Stiff, S, R and A. It will be recognized therefore that the blank defined above is not the only blank which could be produced to meet the objectives of the invention, and indeed blanks could be produced in other metals such as aluminium and titanium.

It is usual in the golf industry for a 1 iron to be 39.5" in length measured in the industry recognized manner from the end of the grip to the back of the heel of the club head. The 9 iron has a length of 35.5", and the intermediate irons between the 1 iron and the 9 iron are progressively 0.5" shorter for each iron in the progression from 1 iron to 9 iron.

Generally the pitching wedge and the sand wedge have the same length as the 9 iron (35.5").

Figure 3:
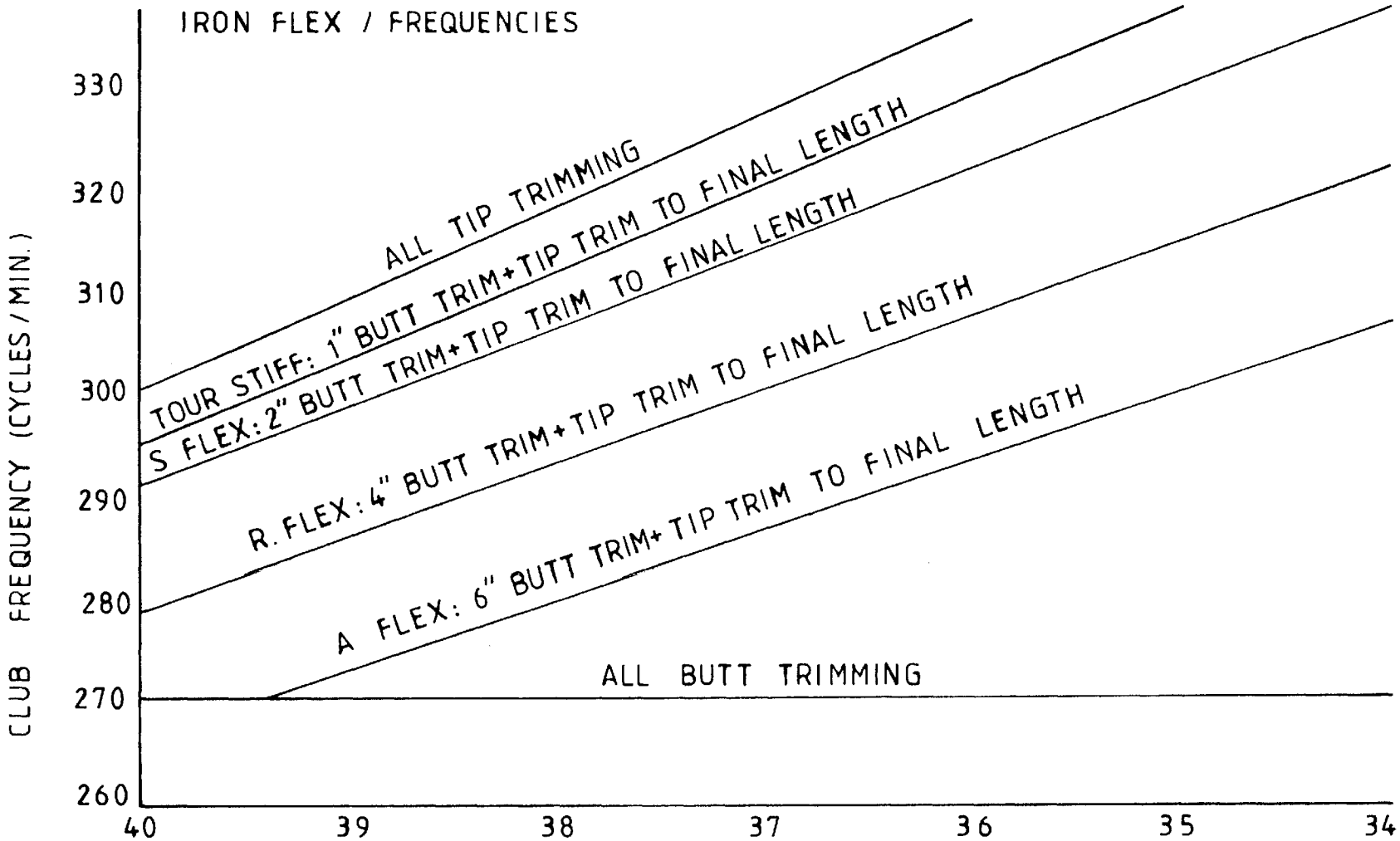

FIG. 3 illustrates how the blank defined above must be trimmed to produce shafts for iron clubs in the range 1 iron to sand wedge and in any one of the recognized flex ranges Tour Stiff, S, R and A. The traces on the graph of FIG. 3 assume that the club produced will have the parameters specified above, namely a swing weight of D3 a clamp length from the butt end of the cut shaft of 4" when used in the standard frequency test, a grip weight of 52 g, a shaft insertion depth in the hosel of the head of 1.25", and a heel to top of hosel dimension of the head of 2.5". The traces are also produced on the basis that in the finally assembled clubs, within any one flex-matched set the club frequency will increase by 5 cycles per minute for each club in the range from 1 iron to sand wedge. Although the lengths of the 9 iron, pitching wedge and sand wedge are the same the difference in heads will produce the 5 cycle change in frequency.

It is clear from FIG. 3 therefore that to produce, from the universal blank, shafts for a matched set of clubs which can be said to be Tour Stiff then 1" should be cut from the butt end of each of the common blanks, and the tip ends should then be trimmed by an amount which leaves the fully trimmed shaft at the appropriate length for the chosen club in the range. In a finished club the amount of the overall length attributable to the end thickness of the grip is taken usually as 0.125" and given the head and hosel parameter mentioned above the amount attributable to the head is 2.5" minus 1.25" i.e. 1.25". Thus to produce a Tour Stiff 1 iron 1" would be cut from the butt end of the 44" blank and 4.875" should be cut from the tip end leaving a shaft 38.125" for use in the 1 iron so that the completed 1 iron is 39.5" in length. The corresponding 5 iron (37.5") in the Tour Stiff range of clubs requires a shaft length of 36.125", and thus the blank would have 1" trimmed from the butt end, and 6.875" trimmed from the tip end. Similarly, it can be seen from FIG. 3 that if an R flex range of clubs is to be produced then 4" should be cut from the butt with the remainder being trimmed from the tip end of the blank to produce the desired shaft length. Using the examples given above a 1 iron in the R flex range would have its shaft produced by cutting 4" from the butt end of the blank and 1.875" being cut from the tip end. The 5 iron would have 4" cut from the butt end of the blank and 3.875" cut from the tip end.

It can seen that the graph of FIG. 3 has club frequency in cycles per minute on its X axis, and club length in inches along the Y axis. The traces marked "ALL TIP TRIMMING" and "ALL BUTT TRIMMING" denote the frequency boundaries beyond which it is not possible to go by trimming the blank desired above. It can be seen therefore that given the head and grip parameters which have been selected for this particular blank it is possible to produce iron clubs in the range 1 to sand wedge and in the flex ranges Tour Stiff, S, R and A without changing the blank.

It will be recognized that any production process it is unlikely that totally identical blanks can be manufactured. However, it is well recognized that it is possible to control the manufacturing process to produce blanks within a predetermined tolerance range, and in order to accommodate the production of golf club shafts from blanks at different points within the tolerance range it has been determined that simply weighing the blank is sufficient to identify where the blank lies in the tolerance range. Thus where a chart of the kind illustrated in FIG. 3 is used to calculate the amounts to be trimmed from the butt and tip of the blank to produce a particular golf club then a range of traces will be produced equivalent to predetermined weight steps within the weight tolerance range of acceptable blanks. After weighing the blank the user will simply perform the calculation using the appropriate trace for the weight of that blank and the flex required. Similarly where a computer program is provided, for use on a standard personnel computer, the program may require, as an input parameter, the weight of the blank. As a preliminary exercise, the program could determine whether the weight input falls within an acceptable range for known blank configurations. The computer program may be designed to operate with one particular set of head and grip parameters, but desirably it will be able to accommodate different head and grip parameters, and to recommend, in addition to the trimming dimensions, the particular blank from a predetermined range of blanks, the one which would be most appropriate to the set of clubs to be manufactured.

A further parameter which may be input into the computer program is the required frequency relationship between clubs of a set. The above examples are given on the basis of a 5 cycle per minute increase in the frequency for each iron club in the range commencing with the 1 iron. However, if a different gradient is required then the program will check whether or not the proposed blank can accommodate that gradient, and still provide shafts for every club in the proposed set.

We claim:

1. In combination, a tubular metal blank for the production of golf club shafts for iron clubs, the blank being at least 44" in length, having a cylindrical tip portion, a cylindrical butt portion, and an intermediate, integral, tapering portion, remaining parameters of the blank including a material, a taper angle, a length of the intermediate portion, and a wall thickness being so chosen as to produce a blank of a stiffness characteristic such that by appropriate trimming of the butt and tip portions of the blank, the blank can be used to produce a shaft for any golf club from a range of 1 iron to a sand wedge in flex ranges Tour Stiff, S, R and A, and means to determine to a user an amount to be trimmed from the tip and butt portions of the blank to produce a shaft for any iron club in the range of 1 iron to sand wedge, and in flex ranges Tour Stiff, S, R and A.

2. The combination of claim 1 wherein said means to determine the amount to be trimmed from the tip and butt portions of the blank includes a chart from which the appropriate amounts can be read.

3. The combination of claim 1 wherein said means to determine the amount to be trimmed from the tip and butt portions of the blank includes a computer program for application to a standard personal computer whereby desired characteristics of the golf club can be input, and the program will calculate and output the amount to be trimmed from the butt and tip portions of the blank.

* * * * *